United States Patent [19]

Iyoda

[11] Patent Number: 4,958,473

[45] Date of Patent: Sep. 25, 1990

[54] FRAME, ANGLE MEMBER FOR USE IN THE FRAME AND METHOD OF MAKING JOINT PORTION OF THE ANGEL MEMBER

[75] Inventor: Hiroumi Iyoda, Katsuta, Japan

[73] Assignee: Hitachi, Ltd., Tokyo, Japan

[21] Appl. No.: 360,220

[22] Filed: Jun. 2, 1989

[30] Foreign Application Priority Data

Jun. 6, 1988 [JP] Japan ..... 63-137556

[51] Int. Cl.[5] ..... B66B 23/00

[52] U.S. Cl. ..... 52/646; 52/693; 52/726; 198/860.3; 403/339

[58] Field of Search ..... 198/860.1, 860.2, 860.3; 52/726, 645, 643, 94, 693, 655, 634, 633; 403/309, 340, 292

[56] References Cited

U.S. PATENT DOCUMENTS

| | | | |
|---|---|---|---|
| 2,058,537 | 10/1936 | Weiskopf | 52/726 |
| 3,078,970 | 2/1963 | Black | 52/693 |
| 3,707,220 | 12/1972 | Boltrek | 198/860.3 |

*Primary Examiner*—John E. Murtagh

*Attorney, Agent, or Firm*—Antonelli, Terry, Stout & Kraus

[57] ABSTRACT

A frame has elongated upper and lower angle members each comprising two parts both having L-shaped cross sections and joint portions of T-shaped cross sections formed at adjacent end portions of the two parts. The legs of the T-shaped joint portions are connected by a coupling member disposed on the legs and secured thereto by fastening members.

13 Claims, 4 Drawing Sheets

FRAME, ANGLE MEMBER FOR USE IN THE FRAME AND METHOD OF MAKING JOINT PORTION OF THE ANGEL MEMBER

FIELD OF THE INVENTION

The present invention relates to a frame for use as a main frame of an escalator, for example, to an angle member for use in the frame and to a method of making a joint portion of the angle member.

DESCRIPTION OF THE PRIOR ART

In the conventional frame of the class specified above, upper and lower members both having L-shaped cross-sections are connected by connecting members, as disclosed in Japanese Unexamined Patent Publication No. 54-31187 and Japanese Unexamined Utility Model Publication No. 53-39990.

The upper and lower members of the conventional frame are each formed by a plurality of parts connected in series in the longitudinal direction of the frame. Each connection is formed by a coupling member of the same L-shaped cross section bridging adjacent end portions of adjacent pair of parts of the upper or lower member and secured to the adjacent ends by bolts. Thus, the coupling members and the bolts of the respective connections project beyond the horizontal and vertical dimensions of the cross-sections of the upper and lower frame members to inconveniently increase the dimension of the frame. Even if the dimensional increase of the frame is slight in amount, such a slight dimensional increase causes a serious problem in the installation of an escalator because such a slight dimensional increase requires a greatly increased installation space.

SUMMARY OF THE INVENTION

It is an object of the present invention to provide a frame in which the horizontal and vertical dimensions of connections between adjacent pairs of parts of upper and lower frame members of an L-shaped or inverted L-shaped cross section are substantially equal to those of the cross-sections of the upper and lower members, respectively.

It is another object of the present invention to provide an angle member having a joint portion of a widthwise dimension which falls within that of the horizontal web of the angle member.

It is a further object of the present invention to provide a method of making at an end of an angle member a joint portion of the class specified in the preceding paragraph.

According to the present invention, a vertical web is removed from an end portion of a length of an angle member of an L-shaped or inverted L-shaped cross section to leave a horizontal web in the end portion. Then, another web is secured by welding to the horizontal web of the end portion such that the other web is offset from the position of the vertical web thus removed toward the center of the width of the horizontal web to cooperate therewith to form a joint portion of an inverted T-shaped cross section or T-shaped cross-section.

The frame according to the present invention includes upper and lower members respectively formed by two such angle members and connecting members interconnecting the upper and lower members. The upper and lower members of the frame, therefore, have joint portions each of a T-shaped or inverted T-shaped cross section. Two such frames are connected together by coupling members respectively placed to bridge vertical webs of adjacent T-shaped or inverted T-shaped joint portions of upper and lower members and secured to the vertical webs by fastening members.

The coupling members are each placed on side faces of the vertical webs of adjacent joint portions of lengths of angle members. Accordingly, each coupling member can be disposed within the dimension of the vertical and horizontal webs at an associated joint portion, as a result that the fastening members can also be placed as within the dimensions of the webs as possible to advantageously assure that the horizontal and vertical dimensions of each connection can be substantially equal to the dimensions of the horizontal web and the vertical web of associated joint potions.

The horizontal web of inverted T-shaped cross section or T-shaped cross section of the joint portion of each angle member of L-shaped cross section is integral and continuous with the horizontal web of an adjacent portion of the angle member. This fact is combined with the welding of the other vertical web to the horizontal web of the joint portion along the entire length thereof to assure that the joint portion is provided with a sufficient mechanical strength.

The above and other objects, features and advantages of the present invention will be made more apparent by the following description with reference to the accompanying drawings.

DESCRIPTION OF PREFERRED EMBODIMENT

Figure 1:
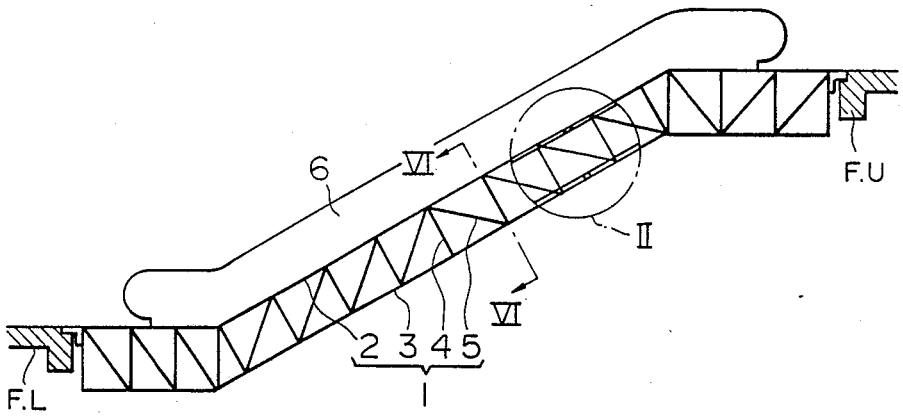
FIG. 1 is a side elevational view of a main frame of an escalator embodying the present invention.

An embodiment of the present invention will be described with reference to FIGS. 1–10 of the drawings. A main frame of an escalator is mounted to extend between upper and lower floors F.U. and F.L. of a building and supports steps (not shown) and handrails one of which is shown by 6. The escalator frame is composed of a pair of right and left side frames 1 and lateral connecting members 7 interconnecting the side frames. Each side frame 1 includes upper and lower members 2 and 3 extending longitudinally of the side frame 1 in parallel relationship with each other and connected one to the other by vertical connecting members which include perpendicular connecting members 4 each intersecting the upper and lower members 2 and 3 substantially at right angles and inclined connecting members 5 each inclined relative to the upper and lower members 2 and 3. The vertical connecting members 4 and 5 cooperate with the upper and lower members 2 and 3 to form a truss structure. The upper member 2 is formed by an angle member of an inverted L-shaped cross section having a horizontal web 2H and a vertical web 2V extending from one end of the width of the horizontal web 2H. The lower member 3 is also formed by an angle member of an L-shaped cross section having a horizontal web 3H and a vertical web 3V extending upwardly from one end of the width of the horizontal web 3H. The upper and lower members 2 and 3 are arranged such that the horizontal webs 2H and 3H extend in the same direction. The right and left side frames 1 are arranged such that the horizontal webs 2H extend towards each other and the horizontal webs 3H extend towards each other.

The escalator main frame of the described structure is divided into a plurality of sections to facilitate transportation and carriage into the building. The divided sections have divided upper and lower members 2A and 2B and 3A and 3B and are assembled and connected with each other at an installation site. For this purpose, the adjacent ends of the divided upper and lower members 2A, 2B, 3A and 3B of the divided sections of the main frame are provided with joint portions. The structural details of such joint portions will be described with reference to FIGS. 9 and 10 which show, as an example, the joint portions J of the divided upper member 2B of a divided main frame section. Within the range of the joint portion J, the vertical web 2V of the divided upper member 2B is cut away and replaced by another vertical web 9 which is laterally offset from the vertical web 2V towards the center of the width of the horizontal web 2H and secured thereto by welding W to cooperate with the horizontal web 2H to form a T-shaped cross-section. This vertical web 9 is formed of an elongated and rectangular plate of a thickness substantially the same as that of the vertical web 2V and bent at one end of the length of the plate to form a slope 9S which is also welded at its free end to the cut end of the vertical web 2V.

The divided upper member 2A and the divided lower members 3A and 3B are also provided with similar joint portions J. The vertical webs 9 of the joint portions J of the divided upper and lower members 2A and 3A and 2B and 3B of adjacent pair of divided sections of the escalator frame are connected together by perpendicular connecting members 4, respectively.

Figure 2:
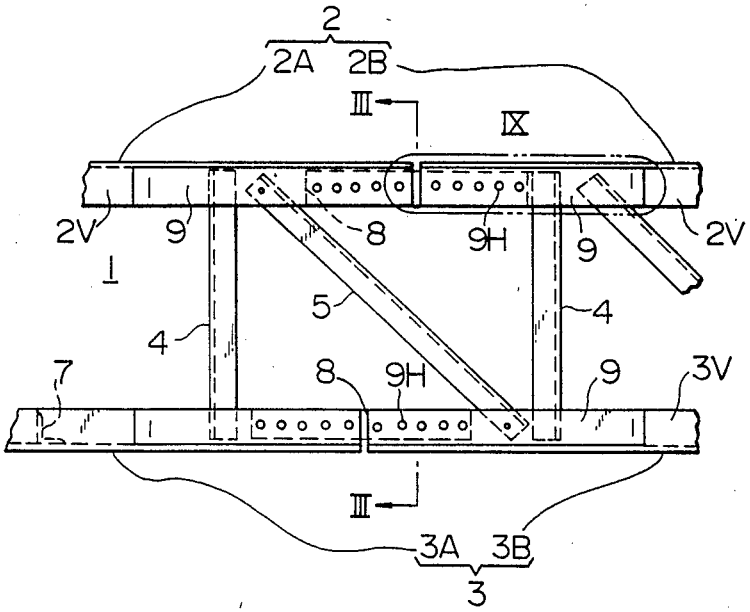
FIG. 2 is an enlarged side view of the portion of the main by a circle II in FIG. 1.
Figure 3:
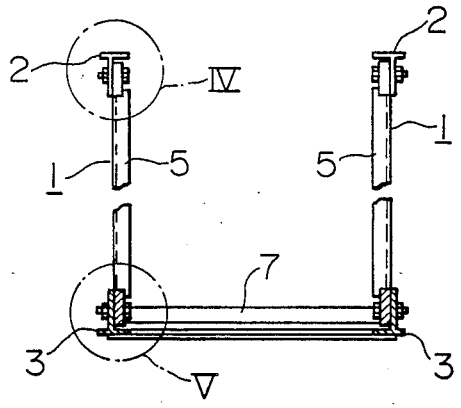
FIG. 3 is an enlarged cross-sectional view of the main frame along line III—III in FIG. 2.

When an adjacent pair of divided sections of the escalator frame are connected together, a pair of coupling members 8 each formed by an elongated rectangular plate are disposed to bridge adjacent ends of the vertical webs 9 of the joint portions J of the upper and lower members 2A and 2B and 3A and 3B, respectively, as shown in FIG. 2. The coupling members 8 are then secured to the vertical webs 9 of the upper and lower members 2A and 2B and 3A and 3B by bolts to connect the upper and lower pairs of the upper and lower members, respectively. For this purpose, the vertical webs 9 and the coupling members 8 are formed therein with bolt holes 9H and 8H for reamer bolts, respectively, to assure that the divided frame sections when connected together are aligned with each other in the longitudinal direction thereof. The coupling members 8 are disposed on those sides of the vertical webs 9 of the joint portions J of the upper and lower members 2 and 3 which are adjacent to the parts of the horizontal webs 2H and 3H which provide longer dimensions from the vertical webs 9 to side edges of the horizontal webs 2H and 3H. Reamer bolts 10 extend through the bolt holes 8H and 9H in the coupling members 8 and the vertical webs 9. Nuts 11 are threaded onto the bolts 10 and tightened against the vertical webs 9 with washers 12 interposed between the nuts and the vertical webs.

The reamer bolts 10 have longitudinal dimensions which are substantially the same as the widthwise dimensions of the horizontal webs 2H and 3H of the upper and lower members. The thickness of each of the coupling members 8 is substantially equal to the widthwise dimension of the horizontal web 2H or 3H minus the total of the axial dimension of the head of each reamer bolt 10, the axial dimension of the nut 11, the thickness of the washer 12 and the thickness of the vertical web 9.

When the connections between the divided upper members 2A and 2B are between the divided lower members 3A and 3B are completed, the adjacent pair of divided frame sections are further connected by an inclined connecting member 5 which is connected at one end to the vertical web 9 of the upper member 2A of one of the divided frame sections by a reamer bolt (not shown) and at the other end to the vertical web 9 of the lower member 3B of the other divided frame section by a reamer bolt (not shown) to complete the connection between the adjacent pair of divided frame sections.

According to the embodiment of the invention described above, the coupling members which connect divided sections of each side frame 1 do not extend beyond the widthwise or lateral dimensions of the upper and lower members 2 and 3 to advantageously reduce the widthwise dimension of the main frame of an escalator to assure that the space for the installation of the escalator can be decreased. The horizontal webs 2H and 3H of the upper and lower members 2 and 3, including the joint portions J, are each of a seamless unitary structure and, in addition, the vertical webs 9 are welded to the horizontal webs 2H and 3H along the entire lengths of the joint portions J of the webs 2H and 3H to assure a sufficient mechanical strengths of the joint portions J.

It would be possible to provide an angle member of an L-shaped cross section with a joint portion by welding an angle member of an inverted T-shaped (or T-shaped) cross section to an end of the L-shaped angle member. In this case, however, the welding is conducted only between the horizontal web of the L-shaped angle member and the horizontal web of the inverted T cross section angle member. Accordingly, the structure of the joint portion prepared according to the present invention provides an increased mechanical strength to improve the reliability.

Figure 4:
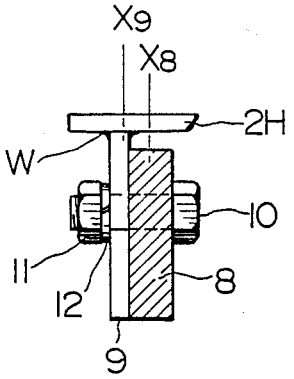
FIG. 4 an enlarged view of the portion of the main frame by a circle IV in FIG. 3.
Figure 5:
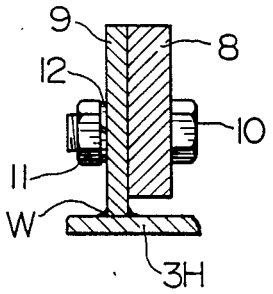
FIG. 5 is an enlarged view of the portion of the main frame indicated by a circle V in FIG. 3.
Figure 6:
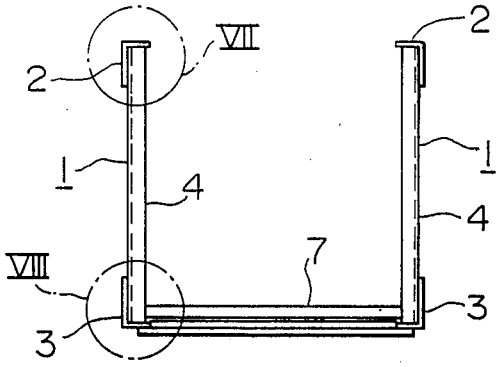
FIG. 6 is an enlarged cross-sectional view of the main frame taken along line VI—VI in FIG. 1.
Figure 7:
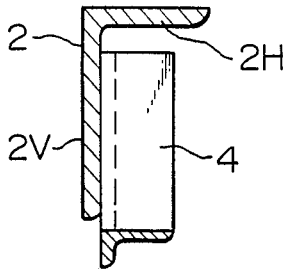
FIG. 7 is an enlarged view of the portion of the main frame indicated by a circle VII in FIG. 6.
Figure 8:
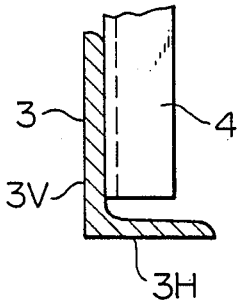
FIG. 8 is an enlarged view of the portion of the main frame indicated by a circle VIII in FIG. 6.
Figure 9:
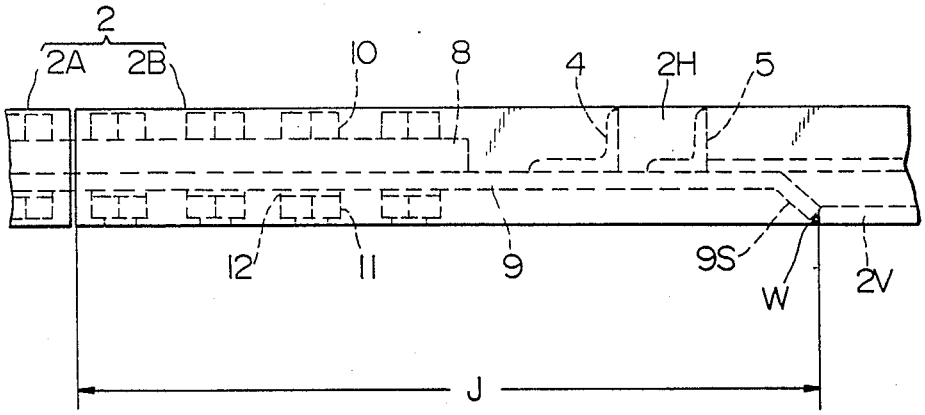
FIG. 9 is an enlarged view of the portion of the main frame indicated by an oval circle IX in FIG. 2.
Figure 10:
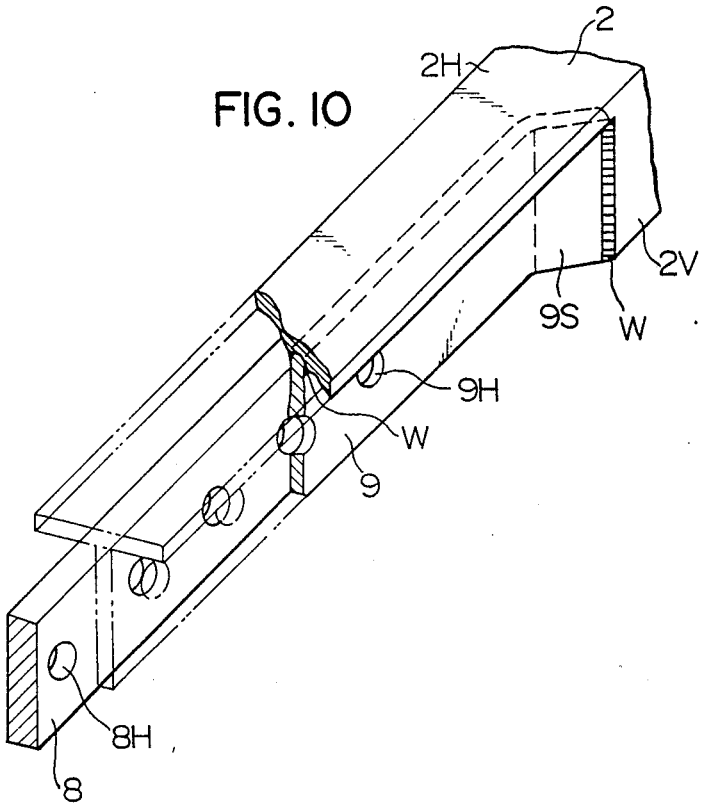
FIG. 10 is a perspective view of a joint between angle members according to the present invention.

Moreover, according to the structure of the joint portion J of the invention, the spacing between a neutral axis X8 of each coupling member 8 and a neutral axis 9X of an inverted T-shaped cross section formed by an associated horizontal web 2H and the vertical web 9 welded thereto, as shown in FIG. 4, is smaller than such spacing in the conventional joint portion to reduce the bending moment which acts on an associated reamer bolt 10.

In the described and illustrated embodiment of the invention, moreover, the component parts for connecting the divided frame sections, such as coupling members 8, bolts 10, nuts 11 and washers 12, are so arranged as not to project beyond the dimensions of the horizontal webs 2H and 3H of the upper and lower members 2 and 3. It will be allowable in some cases that such connecting component parts project to a certain extent beyond the dimensions of the webs 2H and 3H. In such cases, however, the tightening faces of the bolts 10 and nuts 11, i.e., the inwardly directed faces of the bolts 10 and nuts 11 which abut against the coupling member 8 and against the washers 12, should be disposed within the dimensions of the horizontal webs 2H and 3H so as to assure a reduction in the dimensions of the escalator side frames 1 measured laterally thereof, i.e., axially of the nuts.

As will be understood from the foregoing description, the present invention provides a frame in which the joint portions of the upper member of inverted L-shaped cross-sections and the joint portions of the lower members of L-shaped cross-sections are connected respectively by coupling members having dimensions, as measured laterally of the frame, which are substantially equal to the dimensions of the horizontal and vertical webs of the upper and lower members.

In addition, the method of the present invention can provide an angle member with a joint portion having an improved mechanical strength.

What is claimed is:

1. A frame including at least two frame sections each comprising upper and lower members extending longitudinally of said frame and in parallel with each other and connecting members interconnecting said upper and lower members, said upper member having a substantially inverted L-shaped cross section, said lower member having a substantially L-shaped cross section, each of said upper and lower members of each frame section including a joint portion, said frame further including means for coupling the joint portions of said upper and lower members of said frame sections together, wherein the joint portion of said upper member of each frame section has a substantially T-shaped cross section, the joint portion of said lower member of each frame section has a substantially inverted T-shaped cross section and wherein said coupling means comprise elongated and rectangular coupling members respectively attached to side faces of vertical webs of the T-shaped joint portions of the upper members of said frame sections and to side faces of vertical webs of the inverted T-shaped joint portions of said lower members of said frame sections, and means for fastening said coupling members to associated vertical webs.

2. A frame according to claim 1, wherein said coupling members each comprise a plate member.

3. A frame according to claim 1, wherein the vertical webs of said T-shaped and inverted T-shaped joint portions are offset from centers of widths of horizontal webs of said T-shaped and inverted T-shaped joint portions, respectively, and said coupling members are attached to those side faces of said vertical webs which are nearer to the widthwise centers of said horizontal webs.

4. A frame according to claim 1, wherein the horizontal webs of said T-shaped cross section and inverted T-shaped cross section have widthwise and thicknesswise dimensions equal to those of said inverted L-shaped cross section and said L-shaped cross section, respectively.

5. A frame according to claim 2, wherein the horizontal webs of said T-shaped cross section and inverted T-shaped cross section have widthwise and thicknesswise dimensions equal to those of said inverted L-shaped cross section and said L-shaped cross section, respectively.

6. A frame according to claim 3, wherein the horizontal webs of said T-shaped cross section and inverted T-shaped cross section have widthwise and thicknesswise dimensions equal to those of said inverted L-shaped cross section and said L-shaped cross section, respectively.

7. A frame according to claim 4, wherein said fastening means comprises bolts.

8. A frame according to claim 7, wherein said bolts comprise reamer bolts.

9. A frame according to claim 1, wherein said inverted L-shaped cross section and L-shaped cross section of said upper and lower members have vertical webs respectively connected to the vertical webs of said T-shaped cross section and said inverted T-shaped cross section.

10. A frame comprising upper and lower members extending longitudinally of said frame and in parallel with each other, said upper member having a substantially inverted L-shaped cross section, said lower member having a substantially L-shaped cross section, wherein said upper member has an end formed into a joint portion of a substantially T-shaped cross section and said lower member has an end formed into a joint portion of a substantially inverted T-shaped cross section.

11. A frame including at least two frame sections each comprising upper and lower members extending longitudinally of said frame and in parallel with each other and connecting members interconnecting said upper and lower members, said upper member having a substantially inverted L-shaped cross section, said lower member having a substantially L-shaped cross section, each of said upper and lower members of each frame section including a joint portion, said frame further including means for coupling the joint portions of said upper and lower members of said frame sections together, wherein the joint portion of said upper member of each frame section has a substantially T-shaped cross section, the joint portion of said lower member of each frame section has a substantially inverted T-shaped cross section, wherein said coupling means comprise coupling members respectively attached to side faces of vertical webs of the T-shaped joint portions of the upper members of said frame sections and to side faces of vertical webs of the inverted T-shaped joint portions of said lower members of said frame sections, and means for fastening said coupling members to associated vertical webs, and wherein said fastening means have fastening faces disposed within the dimensions of the horizontal webs of said T-shaped and inverted T-shaped cross sections.

12. A frame including at least two frame sections each comprising upper and lower members extending longitudinally of said frame and in parallel with each other and connecting members interconnecting said upper and lower members, said upper member having a substantially inverted L-shaped cross section, said lower member having a substantially L-shaped cross section, each of said upper and lower members of each frame section including a joint portion, said frame further including means for coupling the joint portions of said upper and lower members of said frame sections together, wherein the joint portion of said upper member of each frame section has a substantially T-shaped cross section, the joint portion of said lower member of each frame section has a substantially inverted T-shaped cross section, wherein said coupling means comprise coupling members respectively attached to side faces of vertical webs of the T-shaped joint portions of the upper members of said frame sections and to side faces of vertical webs of the inverted T-shaped joint portions of said lower members of said frame sections, and means for fastening said coupling members to associated vertical webs, and wherein each of said coupling members and associated fastening means are disposed within the dimensions of the horizontal webs of said T-shaped and inverted T-shaped cross sections.

13. A frame structure for a passenger conveyor, comprising a pair of laterally spaced side frames each including at least two frame sections each comprising upper and lower members extending longitudinally of said frame and in parallel with each other and vertical connecting members interconnecting said upper and lower members, said upper member having a substantially inverted L-shaped cross section, said lower member having a substantially L-shaped cross section, each of said upper and lower members of each frame section including a joint portion, said frame further including means for coupling the joint portions of said upper and lower members of said frame sections together, said side frames being arranged such that horizontal webs of said inverted L-shaped cross section and L-shaped cross-section are directed inwardly, said frame structure further including lateral connecting members interconnecting said side frames, wherein the joint portion of said upper member of each frame section has a substantially T-shaped cross section, the joint portion of said lower member of each frame section has a substantially inverted T-shaped cross section and wherein said coupling means comprise coupling members each formed of a plate and respectively attached to inner side faces of vertical webs of the T-shaped joint portions of the upper members of said frame sections and to inner side faces of vertical webs of the inverted T-shaped joint portions of said lower members of said frame sections, and reamer bolts for fastening said coupling members to associated vertical webs.

* * * * *